US010390562B2

(12) United States Patent
Tucker et al.

(10) Patent No.: US 10,390,562 B2
(45) Date of Patent: Aug. 27, 2019

(54) ELECTRONIC SMOKING ARTICLE

(71) Applicant: Altria Client Services LLC, Richmond, VA (US)

(72) Inventors: Christopher S. Tucker, Midlothian, VA (US); Scott A. Fath, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 1275 days.

(21) Appl. No.: 14/333,271

(22) Filed: Jul. 16, 2014

(65) Prior Publication Data

US 2015/0027469 A1 Jan. 29, 2015

Related U.S. Application Data

(60) Provisional application No. 61/857,425, filed on Jul. 23, 2013.

(51) Int. Cl.

| | |
|---|---|
| ***A24F 47/00*** | (2006.01) |
| ***A24D 3/06*** | (2006.01) |
| ***A24D 3/10*** | (2006.01) |

(52) U.S. Cl.

CPC ..... *A24F 47/008* (2013.01); *A24D 3/061* (2013.01); *A24D 3/10* (2013.01)

(58) Field of Classification Search

CPC ..... A61M 15/06; A61M 15/009; A61M 15/0091; A61M 2202/0468; A24F 47/002–008; A24D 3/061; A24D 3/10

See application file for complete search history.

(56) References Cited

U.S. PATENT DOCUMENTS

| | | | | |
|---|---|---|---|---|
| 7,578,298 | B2 | 8/2009 | Karles et al. | |
| 7,878,962 | B2 | 2/2011 | Karles et al. | |
| 2007/0267032 | A1* | 11/2007 | Shan | A24F 47/002 131/275 |
| 2010/0236546 | A1* | 9/2010 | Yamada | A61M 11/042 128/200.21 |
| 2011/0005535 | A1 | 1/2011 | Xiu | |
| 2011/0303231 | A1* | 12/2011 | Li | A24F 47/008 131/329 |
| 2012/0260927 | A1 | 10/2012 | Liu | |
| 2012/0285475 | A1 | 11/2012 | Liu | |

(Continued)

FOREIGN PATENT DOCUMENTS

| | | | |
|---|---|---|---|
| EP | 0845220 | A1 | 6/1998 |
| EP | 2471392 | A1 | 7/2012 |

(Continued)

OTHER PUBLICATIONS

International Search Report and Written Opinion dated Feb. 27, 2015.

Partial International Search Report dated Nov. 27, 2014.

*Primary Examiner* — Michael H. Wilson

*Assistant Examiner* — Yana B Krinker

(74) *Attorney, Agent, or Firm* — Harness, Dickey & Pierce, P.L.C.

(57) ABSTRACT

An electronic smoking article includes a liquid aerosol formulation, a heater operable to at least partially volatilize the liquid aerosol formulation and form an aerosol, and at least one frangible and/or crushable flavor bead. The at least one frangible and/or crushable flavor bead can be positioned in a filter plug.

17 Claims, 5 Drawing Sheets

(56) References Cited

U.S. PATENT DOCUMENTS

| | | | | |
|---|---|---|---|---|
| 2013/0037041 | A1 | 2/2013 | Worm et al. | |
| 2015/0027477 | A1 * | 1/2015 | Yoshino | A24D 3/04 131/337 |

FOREIGN PATENT DOCUMENTS

| | | | | | |
|---|---|---|---|---|---|
| JP | 5235044 | * | 7/2013 | | A24D 3/04 |
| WO | WO-2006082529 | A2 | 8/2006 | | |
| WO | WO-2013068081 | A1 | 5/2013 | | |
| WO | WO2013068100 | * | 5/2013 | | A24D 3/04 |
| WO | WO-2013068304 | A1 | 5/2013 | | |

* cited by examiner

ELECTRONIC SMOKING ARTICLE

CROSS-REFERENCE TO RELATED APPLICATION

This application claims priority under 35 U.S.C. § 119(e) to U.S. provisional Application No. 61/857,425, filed on Jul. 23, 2013, the entire content of which is incorporated herein by reference thereto.

WORKING ENVIRONMENT

Many of the embodiments disclosed herein include electronic smoking articles operable to deliver liquid from a liquid supply reservoir to a heater. The heater volatilizes a liquid to form an aerosol.

SUMMARY OF SELECTED FEATURES

An electronic smoking article operable to produce an aerosol includes a reservoir including a liquid aerosol formulation, a heater operable to at least partially volatilize the liquid aerosol formulation and form an aerosol, a filter including a plug of low resistance-to-draw filter material and at least one frangible and crushable flavor bead, and a compressible encasement adjacent the filter. The flavor bead includes a rupturable shell and a flavor contained in the shell. The filter is arranged downstream of the heater. The flavor can be menthol.

An electronic smoking article operable to produce an aerosol includes a cartomizer section extending in a longitudinal direction and a battery section operable to be connected to the cartomizer section. The cartomizer section includes a reservoir comprising a liquid aerosol formulation, a heater operable to heat the liquid aerosol formulation to a temperature sufficient to at least partially volatilize the liquid aerosol formulation and form an aerosol, a wick in communication with the reservoir and surrounded by the heater such that the wick delivers liquid material to the heater, a first threaded section, a mouth end insert including at least two diverging outlet passages, and at least one frangible and/or crushable menthol flavor bead located adjacent the mouth end insert or adjacent the first threaded section. The at least one frangible and/or crushable menthol flavor bead is operable to release menthol when squeezed and broken by a smoker prior to smoking. The battery section includes a second threaded section operable to be joined with the first threaded section of the cartomizer section at a threaded joint.

A kit includes an electronic smoking article and a plurality of attachable filter elements each comprising a casing, a plug of fibrous material of low resistance-to-draw, and a flavor bead. The casing is configured to slidingly fit onto an end portion of the electronic smoking article. The casing is sufficiently flexible such that a smoker may at its election rupture the flavor bead by squeezing the casing, whereby a content of the flavor bead is released.

DETAILED DESCRIPTION

An electronic smoking article includes a liquid supply region (reservoir) containing a liquid aerosol formulation. The liquid aerosol formulation is delivered to a heater where the liquid aerosol formulation is heated, volatilized, and forms an aerosol. As used herein, the term "electronic smoking article" is inclusive of all types of electronic smoking articles, regardless of form, size or shape, including electronic cigarettes, electronic cigars, electronic pipes, electronic hookahs and the like. The liquid aerosol formulation can include nicotine or be nicotine free. Moreover, the liquid aerosol formulation can include tobacco flavors or instead, or in combination include other suitable flavors.

Preferably, the electronic smoking article also includes at least one frangible and/or crushable flavor bead operable to deliver volatile flavors, such as menthol, to the aerosol as the aerosol passes through the electronic smoking article at the election of a smoker who chooses to break the frangible and/or crush flavor bead with mechanical force. Since volatile flavors can be lost over time, encapsulation of the flavors can abate loss of flavor prior to smoking.

The flavor bead could be located adjacent a mouth end insert or in a filter, such that pressure applied to the mouth end insert or filter, flavor material would be released from the flavor bead. Alternatively, the flavor bead can be included in other locations and broken prior to smoking by various mechanisms as described herein.

Preferably, as shown in FIGS. 2, 3, 4, 6, and 8, the electronic smoking article 60 comprises a replaceable cartridge (or first section) 70 and a reusable fixture (or second section) 72, which are coupled together at a threaded joint 74 or by other convenience such as a snug-fit, snap-fit, detent, clamp and/or clasp.

Figure 3:
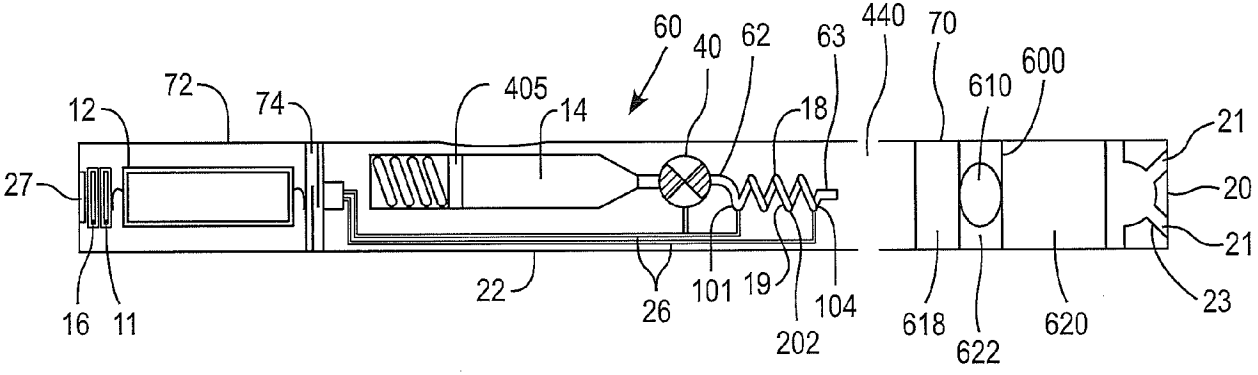
FIG. 3 is a cross-sectional view of another embodiment of an electronic smoking article according to a second embodiment.

As shown in FIG. 3, the first section 70 can house a mouth-end insert 20, at least one flavor bead 610, a capillary aerosol generator including a capillary (capillary tube) 18, a heater 19 to heat at least a portion of the capillary 18, a reservoir 14 and optionally a valve 40. Alternatively, as shown in FIG. 4, the first section 70 can house a mouth end insert 20, the flavor bead 610, a heater 319, a flexible, filamentary wick 328 and a reservoir 314 as discussed in further detail below.

Figure 4:
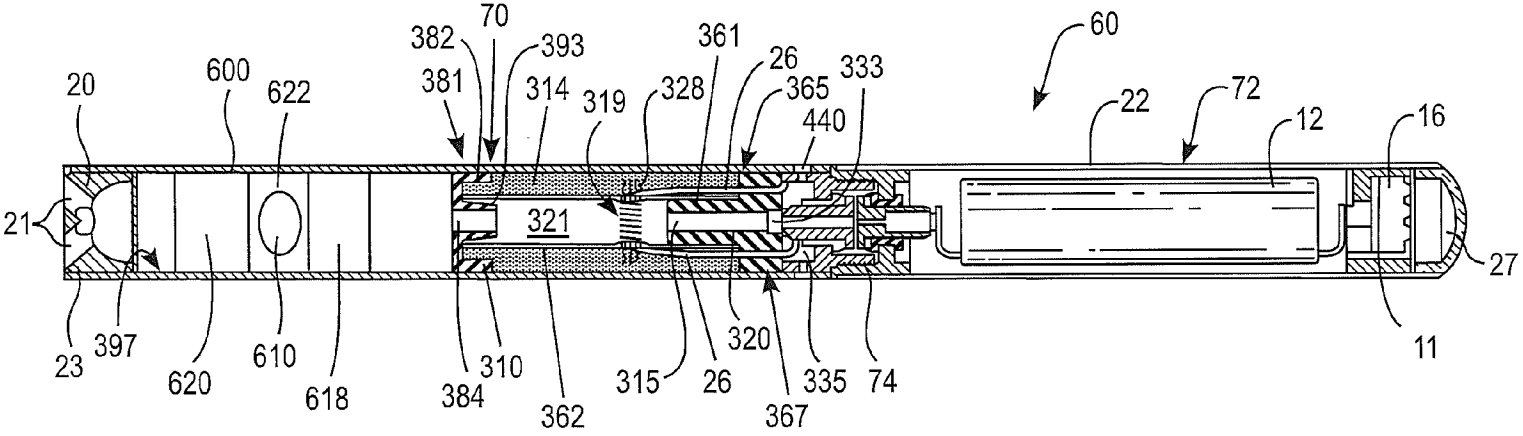
FIG. 4 is a cross-sectional view of an electronic smoking article according to a third embodiment.

The second section 72 can house a power supply 12 (shown in FIGS. 2, 3 and 4), control circuitry 11, and optionally a puff sensor 16 (shown in FIGS. 3 and 4). The threaded portion 74 of the second section 72 can be connected to a battery charger when not connected to the first section 70 for use so as to charge the battery.

Figure 1:
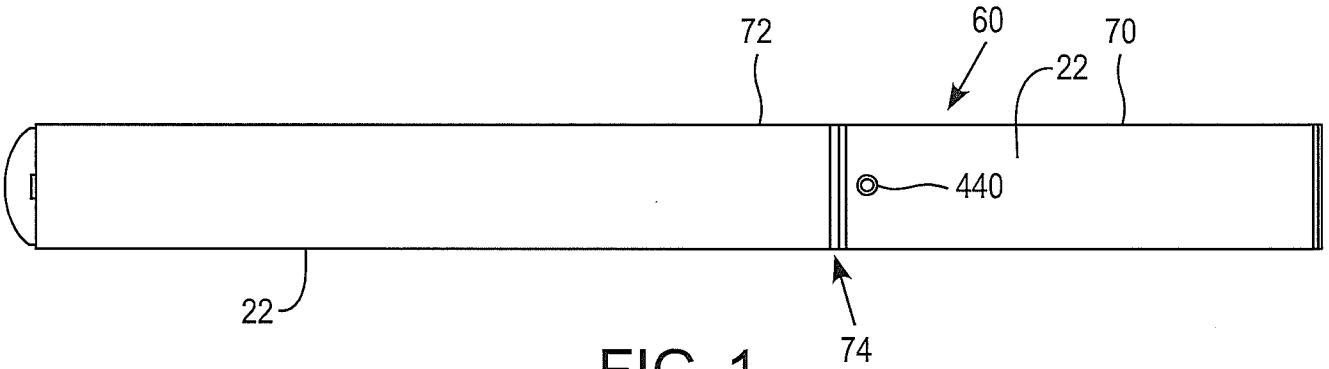
FIG. 1 is a side view of an electronic smoking article constructed according to the teachings herein.
Figure 2:
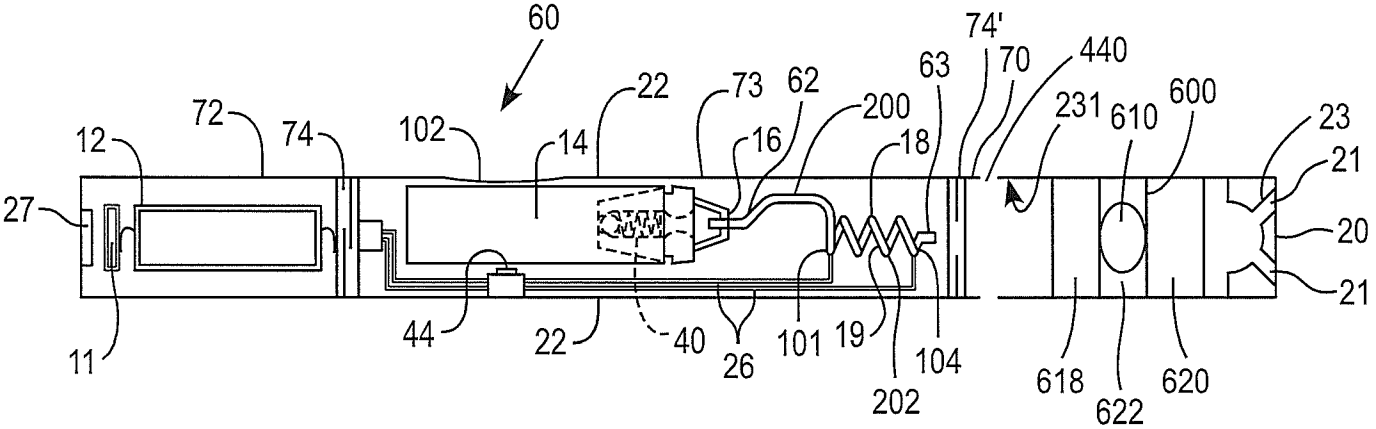
FIG. 2 is a cross-sectional view of an electronic smoking article according to a first embodiment.

As shown in FIG. 2, the electronic smoking article 60 can also include a middle section (third section) 73, which can house the reservoir 14, heater 19 and valve 40. The middle section 73 can be adapted to be fitted with a threaded joint 74' at an upstream end of the first section 70 and a threaded joint 74 at a downstream end of the second section 72. In this embodiment, the first section 70 houses the mouth-end insert 20 and the flavor bead 610, while the second section 72 houses the power supply 12 and control circuitry.

Preferably, the first section 70, the second section 72 and the optional third section 73 include an outer cylindrical housing 22 extending in a longitudinal direction along the length of the electronic smoking article 60. Moreover, in one embodiment, the middle section 73 is disposable and the first section 70 and/or second section 72 are reusable. In another embodiment, the first section 70 can also be disposable so as to avoid the need for cleaning the capillary 18 and/or heater 19. The sections 70, 72, 73 can be attached by threaded connections whereby the middle section 73 can be replaced when the liquid in the reservoir 14 is used up.

It is contemplated that the housing 22 may be a single, unitary piece without threaded connections.

As shown in FIG. 2, the outer cylindrical housing 22 can include a cutout or depression 102 which allows a smoker to manually apply pressure to the reservoir 14. Preferably, the outer cylindrical housing 22 is flexible and/or compressible along at least a portion of the length thereof and fully or partially covers the reservoir 14. The cutout or depression 102 can extend partially about the circumference of the outer cylindrical housing 22. Moreover, the reservoir 14 is compressible such that when pressure is applied to the reservoir, liquid is pumped from the reservoir 14 to the capillary 18. A pressure activated switch 44 can be positioned beneath the reservoir 14. When pressure is applied to the reservoir 14 to pump liquid, the switch is also pressed and a heater 19 is activated. The heater 19 can be a portion of the capillary 18.

In the embodiment of FIG. 2, the reservoir 14 is a tubular, elongate body formed of an elastomeric material so as to be flexible and/or compressible when squeezed. Preferably, the elastomeric material can be selected from the group consisting of silicone, plastic, rubber, latex, and combinations thereof.

Preferably, the compressible reservoir 14 has an outlet 16 which is in fluid communication with a capillary 18 so that when squeezed, the reservoir 14 can deliver a volume of liquid aerosol formulation to the capillary 18. Simultaneous to delivering liquid to the capillary, the power supply 12 is activated upon application of manual pressure to the pressure switch and the capillary 18 is heated to form a heated section wherein the liquid aerosol formulation is volatilized. Upon discharge from the heated capillary 18, the volatilized material expands, mixes with air and forms an aerosol.

Preferably, the reservoir 14 extends longitudinally within the outer cylindrical housing 22 of the first section 70 (shown in FIGS. 3 and 4) or the middle section 73 (shown in FIG. 2). Moreover, the reservoir 14 comprises a liquid aerosol formulation which is volatilized when heated and forms an aerosol when discharged from the capillary 18.

In the embodiments of FIGS. 2 and 3, the capillary 18 includes an inlet end 62 in fluid communication with the outlet 16 of the reservoir 14, and an outlet end 63 operable to expel volatilized liquid aerosol formulation from the capillary 18. In a preferred embodiment, as shown in FIGS. 2 and 3, the reservoir 14 may include a valve 40.

As shown in FIG. 2, the valve 40 can be a check valve that is operable to maintain the liquid aerosol formulation within the reservoir, but opens when the reservoir 14 is squeezed and pressure is applied. Preferably, the check valve 40 opens when a critical, minimum pressure is reached so as to avoid inadvertent dispensing of liquid aerosol formulation from the reservoir 14 or activating the heater 19. Once pressure upon the reservoir 14 is relieved, the valve 40 closes. The heated capillary 18 discharges liquid remaining downstream of the valve 40.

As shown in FIG. 3, in other embodiments, the valve 40 can be a two-way valve and the reservoir 14 can be pressurized. For example, the reservoir 14 can be pressurized using a pressurization arrangement 405 which applies constant pressure to the reservoir 14. For example, pressure can be applied to the reservoir 14 using an internal or external spring and plate arrangement which constantly applies pressure to the reservoir 14. Alternatively, the reservoir 14 can be compressible and positioned between two plates that are connected by springs or the reservoir 14 could be compressible and positioned between the outer housing and a plate that are connected by a spring so that the plate applies pressure to the reservoir 14.

Preferably, the capillary 18 of FIGS. 2 and 3 has an internal diameter of 0.01 to 10 mm, preferably 0.05 to 1 mm, and more preferably 0.05 to 0.4 mm. Also preferably, the capillary 18 may have a length of about 5 mm to about 72 mm, more preferably about 10 mm to about 60 mm or about 20 mm to about 50 mm. In one embodiment, the capillary 18 is substantially straight. In other embodiments, the capillary 18 is coiled and/or includes one or more bends therein to conserve space and/or accommodate a long capillary.

In these embodiments, the capillary 18 is formed of a conductive material, and thus acts as its own heater 19 by passing current through the capillary. The capillary 18 may be any electrically conductive material capable of being resistively heated, while retaining the necessary structural integrity at the operating temperatures experienced by the capillary 18, and which is non-reactive with the liquid aerosol formulation. Suitable materials for forming the capillary 18 are selected from the group consisting of stainless steel, copper, copper alloys, porous ceramic materials coated with film resistive material, Inconel® available from Special Metals Corporation, which is a nickel-chromium alloy, nichrome, which is also a nickel-chromium alloy, and combinations thereof.

Alternatively, the capillary 18 may be a non-metallic tube such as, for example, a glass tube having a conductive material capable of being resistively heated, such as, for example, stainless steel, nichrome or platinum wire, arranged there along.

Preferably, at least two electrical leads 26 are bonded to a metallic capillary 18 by brazing or crimping. Preferably, one electrical lead 26 is attached to a first, upstream portion 101 of the capillary 18 and a second electrical lead 26 is attached to a downstream, end portion 104 of the capillary 18, as shown in FIGS. 2 and 3.

In an alternative embodiment, an electronic smoking article can include a heater 319 and a filamentary wick 328 as shown in FIG. 4. The first section 70 includes an outer tube (or casing) 22 extending in a longitudinal direction and an inner tube (or chimney) 362 coaxially positioned within the outer tube 322. Preferably, a nose portion 361 of an upstream gasket (or seal) 320 is fitted into an upstream end portion 365 of the inner tube 362, while at the same time, an outer perimeter 367 of the gasket 320 provides a liquid-tight seal with an interior surface 397 of the outer housing 22. The upstream gasket 320 also includes a central, longitudinal air passage 315, which opens into an interior of the inner tube 362 that defines a central channel 321. A transverse channel 333 at an upstream portion of the gasket 320 intersects and communicates with the central channel 315 of the gasket 320. This channel 333 assures communication between the central channel 315 and a space 335 defined between the gasket 320 and a threaded connection 74.

Preferably, a nose portion 393 of a downstream gasket 310 is fitted into a downstream end portion 381 of the inner tube 362. An outer perimeter 382 of the gasket 310 provides a substantially liquid-tight seal with an interior surface 397 of the outer housing 22. The downstream gasket 310 includes a central channel 384 disposed between the central passage 321 of the inner tube 362 and the mouth end insert 20.

In this embodiment, the reservoir 314 is contained in an annulus between an inner tube 362 and an outer housing 22 and between the upstream gasket 320 and the downstream gasket 310. Thus, the reservoir 314 at least partially surrounds the central air passage 321. The reservoir 314 comprises a liquid aerosol formulation and optionally a liquid storage medium (not shown) operable to store the liquid aerosol formulation therein.

The inner tube 362 has a central air passage 321 extending therethrough which houses the heater 319. The heater 319 is in contact with the filamentary wick 328, which preferably extends between opposing sections of the reservoir 314 so as to deliver the liquid aerosol formulation from the reservoir to the heater 319.

Preferably, the electronic smoking article 60 of each embodiment described herein also includes at least one air inlet 440. In the embodiment of FIG. 4, the at least one air inlet 440 can be located upstream of the heater 319.

In the embodiments of FIGS. 2 and 3, the at least one air inlet 440 is arranged downstream of the capillary 18 so as to minimize drawing air along the capillary and thereby avoid cooling of the capillary 18 during heating cycles.

The power supply 12 of each embodiment can include a battery arranged in the electronic smoking article 60. The power supply 12 is operable to apply voltage across the heater 19 associated with the capillary 18, as shown in FIGS. 2 and 3, or the heater 319 associated with the wick 328, in the embodiment of FIG. 4. Thus, the heater 19, 319 volatilizes liquid aerosol formulation according to a power cycle of either a predetermined time period, such as a 2 to 10 second period.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker until the energy in the power supply is depleted. Alternatively, the power supply 12 may be rechargeable and include circuitry allowing the battery to be chargeable by an external charging device. The control circuitry 11 can be programmable and can include an application specific integrated circuit (ASIC). In other embodiments, the control circuitry 11 can include a microprocessor programmed to carry out functions such as heating the capillaries and/or operating the valves.

Preferably, the electronic smoking article 60 of each embodiment also includes control circuitry which can be on a printed circuit board 11 (shown in FIGS. 2, 3 and 4). The control circuitry 11 can also include a heater activation light 27 (shown in FIGS. 2, 3 and 4) that is operable to glow when the heater 19, 319 is activated.

As shown in FIGS. 2-11, the electronic smoking article 60 can include at least one flavor bead 610. Moreover, as shown in FIGS. 2, 3, 4, 6, 8, 10 and 11, the at least one flavor bead 610 can be positioned within a filter 600. Preferably, the flavor bead 610 is embedded in a plug of cellulose acetate tow, which plug may optionally include a plug wrap. The flavor bead 610 can prevent loss of flavor prior to smoking. Moreover, by including flavor material in the flavor bead 610, a smoker can choose to release the flavor material from the flavor bead 610 if desired.

Figure 11:
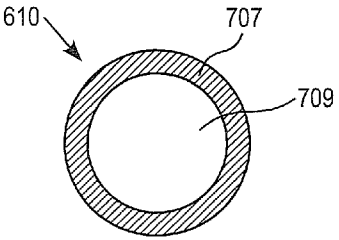
FIG. 11 is a cross-sectional view of a flavor bead of the disclosed embodiments.

Referring to FIG. 11, the flavor bead 610 may comprise an outer shell 707 which encloses an inner core 709 containing menthol or other volatile flavors. For example, the inner core 709 can contain other mint flavors such as peppermint or spearmint. The flavor beads can each have a diameter ranging from about 0.5 mm to about 5 mm (e.g., about 1 mm to about 4 mm or about 2 mm to about 3 mm). Preferably, the size is selected such that aerosol may pass by the flavor bead 610 if the bead remains in an uncrushed condition during smoking. The flavor beads 610 can be manufactured and/or include the features of the flavor beads and/or flavor capsules disclosed in U.S. Pat. No. 7,878,962 to Karles et al., which issued Feb. 1, 2011, and U.S. Pat. No. 7,578,298 to Karles et al., which issued Aug. 25, 2009, the entire content of each of which is incorporated herein by this reference thereto.

The crush strength of the flavor bead 610 can vary, but preferably provides sufficient physical strength to avoid breakage prior to smoking. Moreover, the crush strength of the flavor bead 610 is not so great as to prevent a smoker from crushing and/or breaking the flavor bead 610 by squeezing the filter 600 of the electronic smoking article 60. Preferably, the crush strength of the flavor beat 610 ranges from about 0.5 kilogram force to about 3 kilogram force (e.g., about 0.5 kilogram force to about 2.5 kilogram force or about 1.0 kilogram force to about 2.0 kilogram force).

Figure 6:
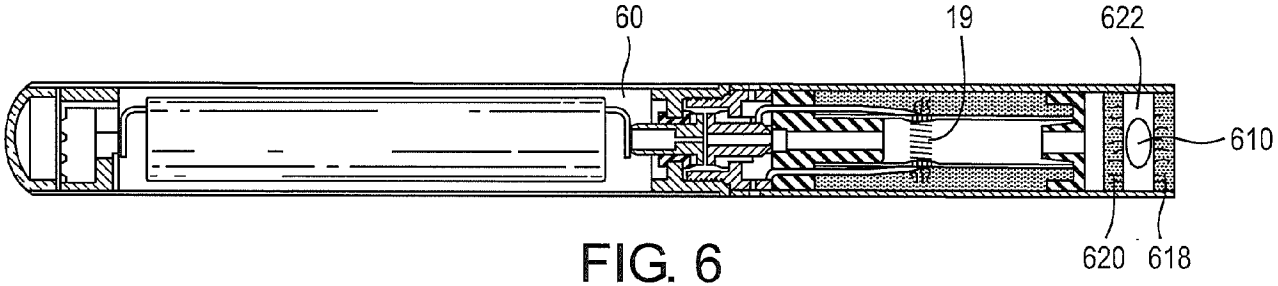
FIG. 6 is a cross-sectional view of an electronic smoking article according to a fourth embodiment including the filter of FIG. 5.
Figure 8:
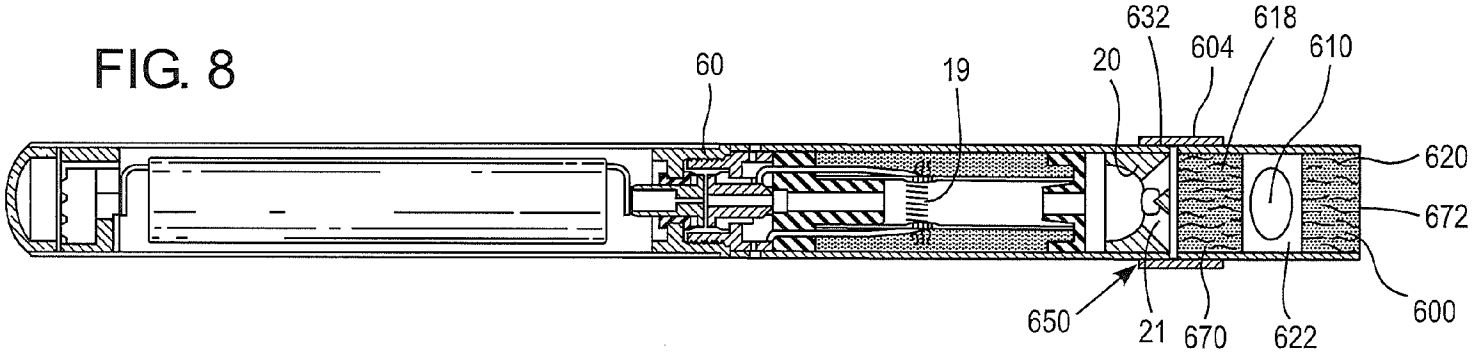
FIG. 8 is a cross-sectional view of an electronic smoking article according to a fifth embodiment including the detachable filter of FIG. 7.
Figure 10:
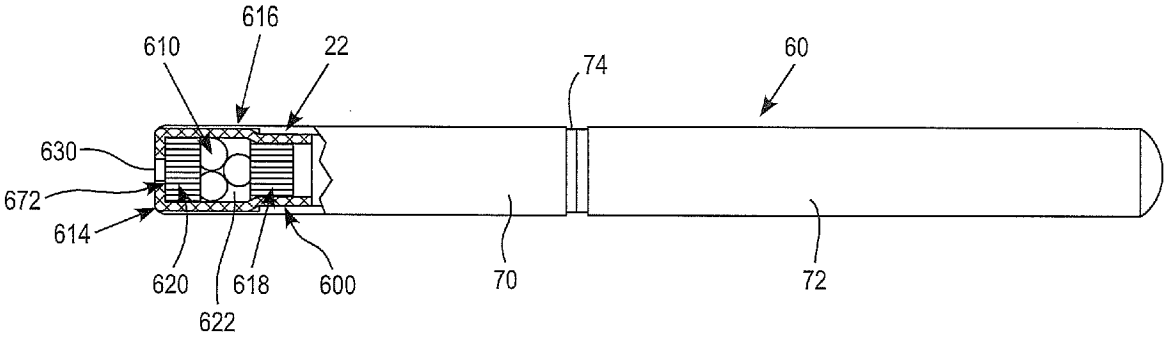
FIG. 10 is a partial, cross-sectional view of an electronic smoking article according to a sixth embodiment including a flexible filter section including at least one flavor bead.

Preferably, as shown in FIGS. 2, 3, 4, 6, 8 and 11 the electronic smoking article 60 includes the filter 600 at a location downstream of the heater 19, 319. The filter 600 can be at least partially inserted into the outer housing 22 at a mouth end 650 of the electronic smoking article 60 as shown in FIGS. 6, 8 and 10. Alternatively, the filter 600 can be fully inserted into the housing 22, such that the filter 600 is upstream of the mouth end insert 20 as shown in FIGS. 2, 3, and 4. In some embodiments shown in FIGS. 6 and 10, the electronic smoking article 60 can include the filter 600, but does not include the mouth end insert 20.

The addition of a filter 600 can aid in adjusting the resistance to draw of the electronic smoking article 60. Additionally, the filter 600 can alter the character of the aerosol by providing additional flavor material to the aerosol during smoking. Because the filter 600 includes the at least one frangible, crushable flavor bead 610, a smoker can choose whether or not to break the at least one flavor bead 610 prior to or during smoking. Thus, the electronic smoking article 60 can be configured to provide an aerosol with or without flavorants.

Figure 7:
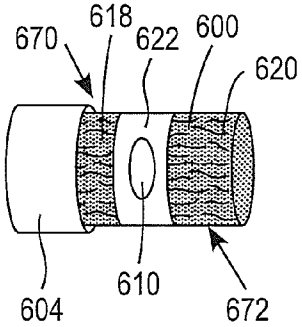
FIG. 7 is a perspective view of a detachable filter including a flavor bead.
Figure 5:
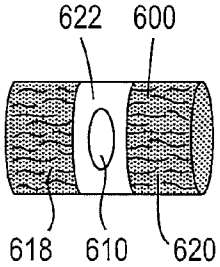
FIG. 5 is a perspective view of a filter including a flavor bead as described herein.

Preferably, the filter 600 is manufactured as a permanent part of the first section 70, and thus, would be discarded along with a disposable first section 70. In an alternative embodiment, the filter 600 can be a detachable filter 600 as shown in FIGS. 7 and 8.

In an embodiment, the filter 600 comprises low efficiency filter material, such as cellulose acetate tow of about 3.0 to about 5.5 denier per filament, more preferably about 3.5 denier per filament. The filter 600 can include at least one bundle of fibrous material formed as a plug. The fibrous material can comprise cellulose acetate fibers, polyester fibers, polypropylene fibers, paper and other fibrous filter materials. For example, the filter 600 can comprise cellulose acetate tow and can be wrapped with a plug wrap if desired or inserted into the outer housing 22 of the electronic smoking article 60 without a plug wrap.

The filter 600 can have a length of about 3 mm to about 10 mm. Preferably, the diameter of the filter 600 is about the same or slightly larger than the diameter of the electronic smoking article 60 so as to assure a snug fit.

Figure 12:
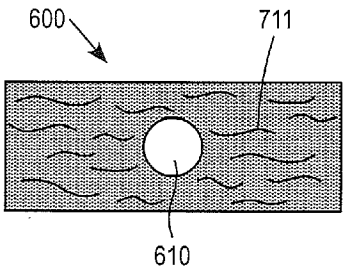
FIG. 12 is a cross-sectional side view of an embodiment of a filter plug with a flavor bead embedded therein.

As shown in FIGS. 2, 3, 4, 5, 6, 7, 8 and 10, in the preferred embodiment, the filter 600 can be a plug-space-plug filter including an upstream plug 618 of fibrous material, a downstream plug 620 of fibrous material and a space 622 therebetween. Referring now to FIG. 12, the filter may comprise a flavor bead 610 embedded in fibers 711 of a unitary plug of fibrous filter material such as cellulose acetate tow. The at least one flavor bead 610 can be contained within the space 622. Preferably, if the filter 600 and/or flavor bead 610 is at least partially contained within the outer housing 22, the portion of the outer housing 22 overlying the filter 600 is flexible and/or compressible such that a smoker can squeeze the filter 600 to break the flavor bead 610 and release the flavorant material therefrom. Accordingly, as the aerosol passes through the filter, the flavor material is eluted into the aerosol so as to alter the sensory experience of the aerosol.

In the preferred embodiment, the filter 600 is constructed to minimize its impact on resistance to draw (RTD) in the electronic smoking article 60 and can be included inside the first section 70 during manufacture or can be detachable for addition to the electronic smoking article 60 if desired by the smoker.

As shown in FIGS. 7 and 8, a separate sleeve portion 604 is designed to fit around at least an upstream portion 270 of the filter 600 to form a detachable (attachable) filter. The sleeve portion 604 is also designed to fit around an outer perimeter 632 of the mouth end 650 of the electronic smoking article 60. The sleeve portion 604 can be sized to friction fit with the filter 600 and with the mouth end 650 of the electronic smoking article 60. The sleeve portion 604 can be colored, scented or include indicia thereon. The sleeve 604 can include a snap-fit mechanism or can simply be held in place by friction fit.

In another embodiment, as shown in FIG. 10, the filter 600 can include an encasement 614, which is flexible and/or compressible and fits around at least a portion of the filter 600. Preferably, the encasement 614 extends over a downstream end 672 of the filter 600. Moreover, the encasement 614 can be formed of a plastic material, such as low density polyethylene, high density polyethylene, polypropylene, polyvinylchloride, polyetheretherketone (PEEK), or silicone and can be sized and configured to fit inside or over an open end of the housing 22 of the electronic smoking article 60 such that a smoker can attach the filter 600 and encasement 614 onto the electronic smoking article 60 if desired. Preferably, the encasement 614 includes at least one outlet 630 at the downstream end 672 of the filter 600 such that aerosol flows through the filter, to the outlet 630, and to the smoker during smoking.

If desired, a flexible wrapper 616 can overly at least a portion of the flexible and/or encasement 614. The flexible wrapper 616 can be a paper or polymeric wrapper that is affixed to the housing 22 and/or the encasement 614. The flexible wrapper 616 and/or the flexible and/or encasement 614 can be colored, scented and/or include indicia thereon.

Detachable filters 600, as shown in FIGS. 7 and 8, and/or filters 600 including encasements 614, as shown in FIG. 10, can be purchased in packs including a plurality of filters 600. Each filter 600 can selectively be attached to the electronic smoking article 60 via the sleeve 604 of encasement 614. A smoker could be presented with a plurality of filters 600 and an electronic smoking article 60 for purchase as a kit.

Figure 9:
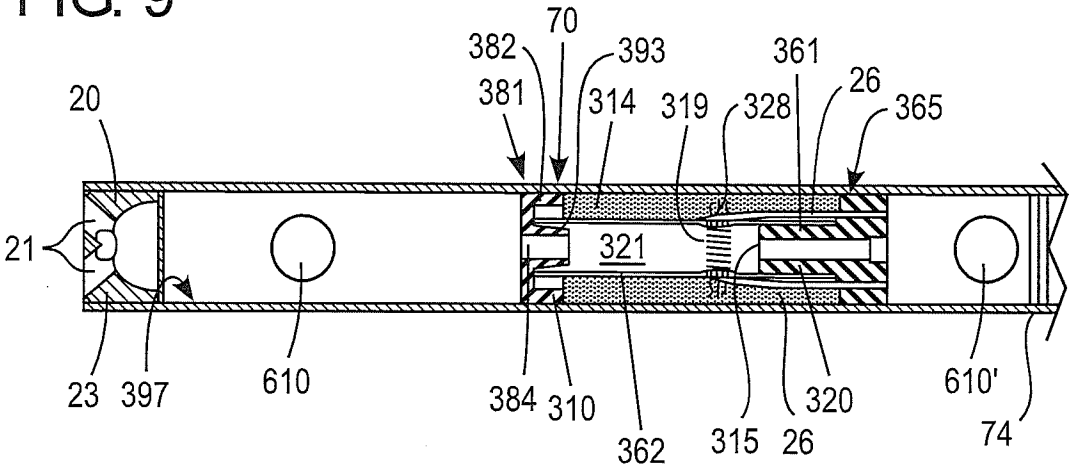
FIG. 9 is an abbreviated, cross-sectional view of an electronic smoking article according to a sixth embodiment including at least one flavor bead.

In an alternative embodiment, as shown in FIG. 9, the at least one flavor bead 610 can be positioned upstream of the mouth end insert 20 and within a portion of the housing 22. In this embodiment, no filter material is included in the electronic smoking article 60. Preferably, the portion of the housing 22 overlying the at least one flavor bead 610 is flexible and/or compressible, such that a smoker can squeeze the housing 22 to rupture the flavor bead 610 and release flavor material therefrom. In addition or in lieu of the flavor bead 610 being located adjacent the mouth end insert 20, a flavor bead 610 can also be located adjacent the threaded joint 74 of the first section 70 such that when the threaded joint 74 is completed between the first section 70 and the second section 72, the flavor bead 610 is ruptured and releases flavor material.

As shown in FIGS. 2, 3, 4, and 8, the electronic smoking article 60 can further include the mouth-end insert 20 having at least two off-axis, preferably diverging outlets 21. Preferably, as shown in FIGS. 2, 3, and 4, the mouth-end insert is located downstream of the filter 600. In other embodiments, as shown in FIG. 8, the filter 600 can be downstream of the mouth-end insert 20.

Preferably, the mouth-end insert 20 includes at least two diverging outlets 21 (e.g, 3, 4, 5, or preferably 6 to 8 outlets or more). Preferably, the outlets 21 of the mouth-end insert 20 are located at ends of off-axis passages 23 and are angled outwardly in relation to the longitudinal direction of the electronic smoking article 60 (i.e., divergently). As used herein, the term "off-axis" denotes at an angle to the longitudinal direction of the electronic smoking article.

In these embodiments, the electronic smoking article 60 is about the same size as a conventional smoking article. In some embodiments, the electronic smoking article 60 can be about 80 mm to about 110 mm long, preferably about 80 mm to about 100 mm long and about 7 mm to about 8 mm in diameter. For example, in an embodiment, the electronic smoking article is about 84 mm long and has a diameter of about 7.8 mm.

The outer cylindrical housing 22 of the electronic smoking article 60 may be formed of any suitable material or combination of materials. Preferably, the outer cylindrical housing 22 is formed of metal and is part of the electrical circuit. Also preferably, as described herein, at least a portion of the housing 22 is flexible and/or compressible, such that a smoker can squeeze the housing 22 and break the at least one flavor bead 610 prior to or during smoking.

Although the preferred embodiments are cylindrical in cross-section, the electronic smoking article may instead have a non-circular cross-sectional shape, such as square, rectangular, triangular, oval, and others.

Preferably, the liquid aerosol formulation for use in each of the electronic smoking articles 60 described herein includes at least one aerosol former, optionally water, and flavors. The liquid aerosol formulation can include nicotine or be nicotine free. Moreover, the liquid aerosol formulation can include tobacco flavors or other suitable flavors.

In the embodiments, the at least one aerosol former is selected from the group consisting of propylene glycol, glycerin and combinations thereof. Preferably, the at least one aerosol former is included in an amount ranging from about 40% by weight based on the weight of the liquid formulation to about 90% by weight based on the weight of the liquid formulation (e.g., about 50% to about 80%, about 55% to about 75% or about 60% to about 70%).

Preferably, the liquid formulation also includes water. Water can be included in an amount ranging from about 5% by weight based on the weight of the liquid formulation to about 20% by weight based on the weight of the liquid formulation, more preferably in an amount ranging from about 10% by weight based on the weight of the liquid formulation to about 15% by weight based on the weight of the liquid formulation.

The liquid aerosol formulation optionally includes at least one flavorant in an amount ranging from about 0.2% to about 15% by weight (e.g., about 1% to about 12%, about 2% to about 10%, or about 5% to about 8%). The at least one flavorant can be a natural flavorant or an artificial flavorant. Preferably, the at least one flavorant is selected from the group consisting of tobacco flavor, menthol, wintergreen, peppermint, herb flavors, fruit flavors, nut flavors, liquor flavors, and combinations thereof.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. An electronic vaping device configured to produce a vapor comprising:

a formulation;

a heater configured to at least partially vaporize the formulation;

a filter arranged downstream of the heater, the filter including, a plug of filter material, the plug having an end surface and a side surface, and at least one crushable flavor bead, the at least one crushable flavor bead comprising a rupturable shell and a flavor contained inside the rupturable shell; and a compressible sheath adjacent the filter, the compressible sheath formed of at least one polymer, and the compressible sheath having an end surface defining an outlet and a side surface, the compressible sheath extending over at least a portion of each of the end surface and the side surface of the plug.

2. The electronic vaping device of claim 1, wherein the plug comprises:

a first filter plug; and a second filter plug, and wherein the at least one crushable flavor bead is between the first filter plug and the second filter plug.

3. The electronic vaping device of claim 1, wherein the filter has a length ranging from about 2 mm to about 10 mm and an outer diameter that is about the same or less than an inner diameter of an outer housing of the electronic vaping device.

4. The electronic vaping device of claim 1, wherein the filter is detachable and a separate sleeve is configured to attach the filter to the electronic vaping device.

5. The electronic vaping device of claim 1, wherein the filter is disposable.

6. The electronic vaping device of claim 1, wherein the at least one crushable flavor bead comprises at least two flavor beads.

7. The electronic vaping device of claim 1, wherein the at least one crushable flavor bead has a crush strength ranging from about 0.5 kilogram force to about 3 kilogram force.

8. The electronic vaping device of claim 1, wherein the at least one flavor crushable bead has a diameter ranging from about 0.5 mm to about 5.0 mm.

9. The electronic vaping device of claim 1, wherein the heater comprises a capillary tube in fluid communication with a reservoir, the reservoir containing the formulation.

10. The electronic vaping device of claim 9, wherein the reservoir is pressurized and includes a mechanically or electrically operated valve at an outlet of the reservoir.

11. The electronic vaping device of claim 9, wherein the reservoir is compressible, such that the formulation is manually pumped to the capillary tube.

12. The electronic vaping device of claim 1, wherein the heater is a coil heater in communication with a filamentary wick which draws the formulation via capillary action.

13. The electronic vaping device of claim 12, further comprising:

an outer tube extending in a longitudinal direction;

an inner tube within the outer tube; and the formulation contained in an outer annulus between the outer tube and the inner tube, wherein the coil heater is located in the inner tube and the filamentary wick is in communication with the formulation and surrounded by the coil heater, such that the filamentary wick delivers the formulation to the coil heater and the coil heater heats the formulation to a temperature sufficient to vaporize the formulation and form a vapor in the inner tube.

14. The electronic vaping device of claim 13, further comprising:

a first section; and a second section, the first section attachable to the second section, wherein the filamentary wick, the formulation, and filter are contained in the first section, and a power supply configured to apply voltage across the heater is contained in the second section.

15. The electronic vaping device of claim 1, wherein the filter material is selected from the group consisting of cellulose acetate, polyester, polypropylene, paper, and combinations thereof.

16. The electronic vaping device of claim 1, wherein the flavor is menthol.

17. A kit comprising:

an electronic vaping device; and a plurality of attachable filter elements each comprising a sheath, a plug of filter material, and a flavor bead, the plug including an end surface and a side surface, the sheath having an end surface defining an outlet and a side surface, the sheath extending over at least a portion of each of the end surface and the side surface of the plug, the sheath configured to slidingly fit with an end portion of the electronic vaping device, the sheath being sufficiently flexible such that an adult vaper smoker may ruptures the flavor bead by squeezing the sheath, whereby a content of the flavor bead is released.

* * * * *